US005282437A

United States Patent [19]

Avillez de Basto

[11] Patent Number: 5,282,437

[45] Date of Patent: Feb. 1, 1994

[54] PERSONAL MARINE TRANSPORT

[76] Inventor: Luiz J. Avillez de Basto, 7381 SW. 133 Terr., Miami, Fla. 33156

[21] Appl. No.: 934,112

[22] Filed: Aug. 21, 1992

[51] Int. Cl.[5] ..... B63B 7/06

[52] U.S. Cl. ..... 114/345; 114/270; 114/363

[58] Field of Search ..... 114/345, 270, 363; 441/65

[56] References Cited

U.S. PATENT DOCUMENTS

| | | | |
|---|---|---|---|
| 1,667,912 | 5/1928 | Vlahon | 441/40 |
| 4,726,311 | 2/1988 | Niina | 114/270 |
| 4,754,724 | 7/1988 | Murakami et al. | 114/270 |
| 4,756,700 | 7/1988 | Coleman | 441/65 |
| 5,131,348 | 7/1992 | Roy | 114/345 |

FOREIGN PATENT DOCUMENTS

| | | | |
|---|---|---|---|
| 2523920 | 9/1983 | France | 114/270 |
| 229796 | 9/1989 | Japan | 114/270 |
| 176295 | 7/1991 | Japan | 114/270 |
| 1589635 | 5/1981 | United Kingdom | 114/345 |

*Primary Examiner*—Michael S. Huppert
*Assistant Examiner*—Thomas J. Brahan
*Attorney, Agent, or Firm*—Robert M. Downey

[57] ABSTRACT

A personal marine craft for transporting an individual user across the surface of a body of water. An inflatable buoyancy membrane having independent air chambers, including side buoyancy chambers and a forward bumper chamber is attached to and extends along the sides and about the bow of a central rigid hull. An upper exposed deck of the rigid hull, which is structured and disposed to accommodate the user thereon, hingedly lifts open to provide access to a water-tight engine compartment containing a drive unit, including an engine, fuel tank, battery and air pump for inflating the air chambers. A seat and a steering handle post ar hingedly attached to the rigid hull and are each independently movable between a raised, operable position and a collapsed, stowed position. A lifting handle on the bow and retractable wheels on the transom of the rigid hull facilitate portability on land.

16 Claims, 4 Drawing Sheets

PERSONAL MARINE TRANSPORT

BACKGROUND OF THE INVENTION

1. Field of the Invention

A personal water craft designed primarily for use by one person and including a rigid hull having buoyancy chambers attached to and extending along the sides and about the bow, the water craft being collapsible to facilitate portability and stowage.

2. Description of the Related Art

In recent years, personal water crafts have become increasingly popular for both sport and recreational use. Generally, these personal water crafts are designed for high performance and run on two stroke motors that power an impeller inside a jet pump, producing a substantial thrust. The engine displacements generally range from 432 cc's to 750 cc's, generating about 50 horse power at approximately 6,000 rpm's. The use of a jet pump to produce thrust eliminates the hazards associated with an exposed propeller as found on most engine driven marine vessels, thus lending to their popularity.

One particular type of personal water craft, commonly referred to as a WET BIKE, is designed for seated operation, with one or two passengers, ridden basically in the same manner as a motorcycle or snowmobile with controls on the handlebars that steer a jet pump nozzle on the stern. For safety, some type of emergency shut off switch that attaches to either the driver's wrist or life jacket is usually provided, such that in the event the driver is thrown off, the engine is interrupted causing the craft to stop.

Another type of personal water craft is what is commonly referred to as a JET SKI which is designed to be operated in a standing or kneeling position requiring substantial skill by the operator for balance and maneuvering, due to the low stability of the craft especially at lower speeds. JET SKIS ar fully intended for use as a recreational vehicle, rather than a means of transportation, wherein the operator can expect to get wet from spray and in most instances, frequent falls. Personal water crafts, including WET BIKES and JET SKIS, are being designed to be increasingly powerful due to a significant youth appeal demanding high performance. The power and speed of personal water crafts have increased to the point of rendering the vessels dangerous to both operators and surrounding swimmers and boaters. As a result of recent fatal accidents, as well as the noise which these high performance water crafts generate, they are susceptible to state legislative threats and in many areas their use has become limited, restricted, or totally banned.

Another type of personal water crafts are known as rigid inflatable boats (RIB) which have rigid hulls in combination with an inflatable chamber for increased stability and safety. In most instances, RIB's are used as dinghies, as service vessels, or as a recreational boat. RIB's range in size from 8 feet to 40 feet in length and are usually powered by outboard engines of at least 3 horsepower. Recently, RIB's have been modified to be impelled by jet drivers similar to those found on JET SKIS and WATER BIKES, making them safer and appealing to older age groups.

A particular problem associated with the above-mentioned personal water crafts, including JET SKIS, WET BIKES, and rigid inflatable boats, result from the overall size and weight of the crafts. While most of these water crafts are designed for use by only one or two individuals, transporting the water craft to and from the location of use is rather difficult, requiring several adults and trailers or dollies for moving on land. Because many of these water crafts weigh over 500 pounds, it is often necessary to use a small crane or davit to launch the craft when ramps or beach access is not available. Also, the size of these water crafts requires a large vehicle, such as a pickup truck or a trailer, to transport the water craft to the water from the storage location.

While the above-mentioned personal water crafts are useful and certainly popular for their intended purpose, there still exists a need for a personal water craft which is specifically adapted to safely transport an individual user in either a standing or seated position gently and stably across the surface of calm, shallow waters at relatively low speeds.

SUMMARY OF THE INVENTION

The present invention is directed to a personal marine transport specifically adapted to transport a individual user across the surface of a body of water in either a standing or seated position at low speed. The personal marine transport includes a rigid hull having an upper exposed deck portion to accommodate the operator and an interior water-tight engine compartment containing an engine, fuel tank, battery and air pump therein. An inflatable membrane is attached to and partially surrounds the rigid hull. The inflatable membrane includes independent inflatable air chambers including opposite side buoyancy chambers extending along the sides of the rigid hull and a forward buoyancy chamber extending around the bow to define a forward bumper. A steering assembly includes a steering bar support post having a steering bar with left and right handle grip portions movably attached to the steering post to facilitate turning of the craft. The steering post is hingedly attached to the rigid hull so as to be movable between a raised, operable position and a lowered, stored position extending horizontally along the length of the deck. A collapsible seat is hingedly attached on the deck and moves between a raised position and a collapsed, stowed position. In the collapsed, stowed position, the seat fits flush with the surrounding deck and actually forms a central portion of the deck. The foredeck area is raised to provide a foot rest for the operator when seated while also allowing additional storage room within the engine compartment below the deck. The water craft of the present invention is further provided with a lifting handle at the bow of the rigid hull and retractable wheels fitted to the transom to facilitate portability on land.

The craft is specifically structured and dimensioned to accommodate one person, with the deck being of minimum dimension to facilitate operation in a standing or seated position The rigid hull portion has an overall length of 42 inches, a width 34 inches, and a height of 21 inches. When floating in water, the hull draws a 6 inch draft. When the buoyancy chambers are fully inflated, the total length overall is 54 inches and the beam is 48 inches. The total weight of the craft, including the engine, fuel tanks, air pump and battery, is approximately 125 pounds. The overall dimensions and weight of the personal marine transport enable it to be easily moved by a single adult for transport in the trunk of vans and larger sides of cars. By grasping the lifting handle, the personal marine transport is easily rolled on the retractable to and from the water launching site.

The low speed, relatively quiet, safe, secure and stable characteristics make the water craft of the present invention attractive to all age groups for a variety of uses. The marine transport can be used as a personal dinghy, as a recreational water vehicle, as fishing vessel, for fishing in secluded caves, lakes and creeks or as a water service vehicle to inspect sealwalls, piers, or boat hulls. In areas where power boats and other gas powered vessels are prohibited, the personal marine transport can be equipped with an electrical motor rather than a gas engine.

With the foregoing in mind, it is an object of the present invention to provide a personal water craft which is specifically designed to accommodate an individual operator for transport across a water surface in either a standing or seated position at a relatively low speed.

It is another object of the present invention to provide a personal water craft which is extremely stable, allowing an individual operator to easily stand or sit on the water craft while at idle or moving at low speed across the water surface.

It is a further object of the present invention to provide a personal water craft which is designed to be conveniently collapsed for stowage enabling the water craft to be easily carried in the trunk of a large car.

It is a further object of the present invention to provide a personal water craft which is substantially light in weight and dimensioned to enable a single adult to transport the water craft to and from a water launching site.

It is yet a further object of the present invention to provide a personal water craft which includes retractable wheels and a towing handle to facilitate portability of the water craft on land to and from the water launching site.

It is still another object of the present invention to provide a personal water craft which includes a rigid hull and an inflatable structure attached thereto including buoyancy chambers extending along the sides and are about the bow of water craft to provide increased stability and protection from impact, and further including an air pump within the water craft to facilitate inflation of the buoyancy chambers.

These and other objects and advantages of the present invention will become more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
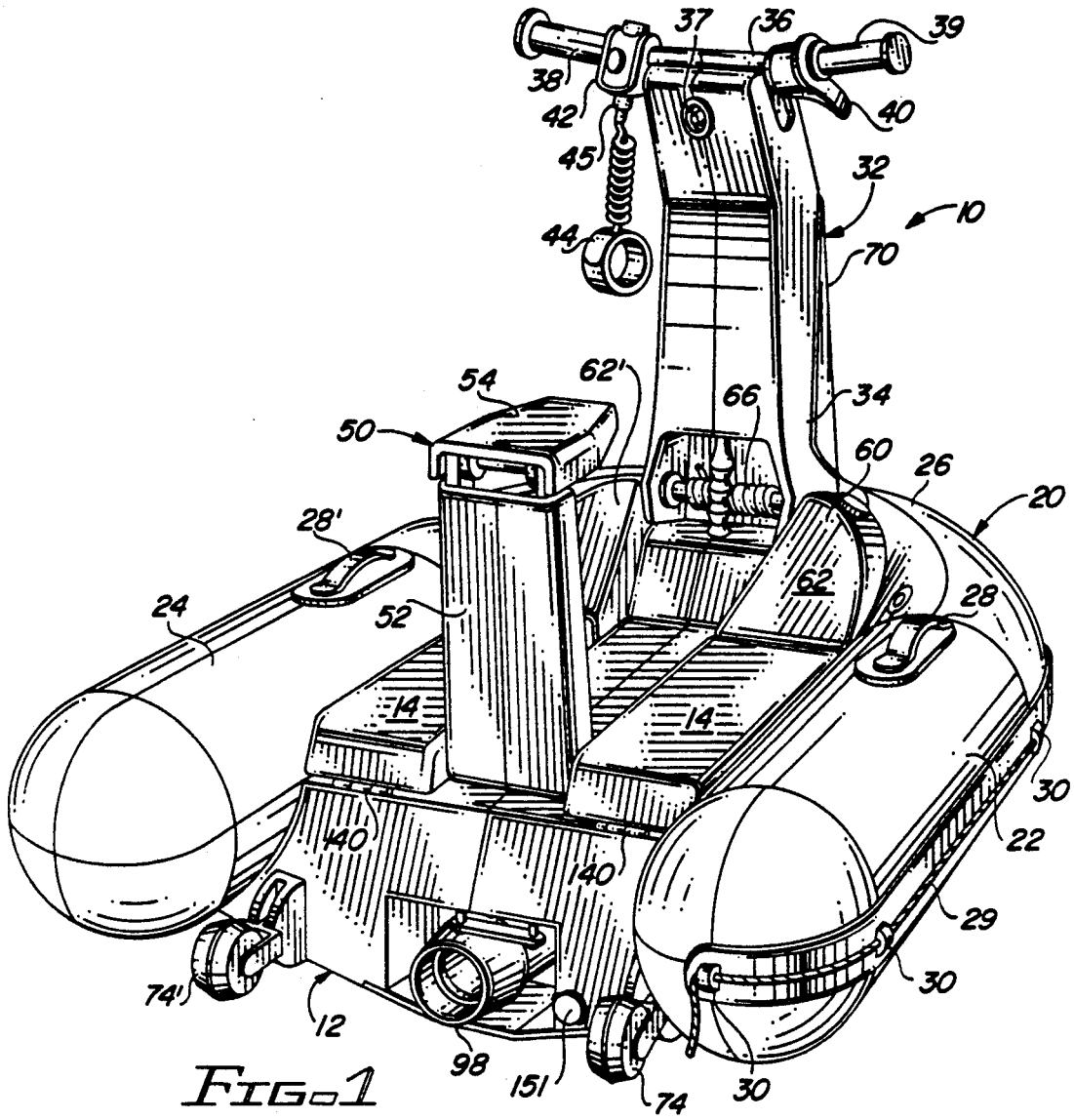
FIG. 1 is a rear perspective view of the personal marine transport of the present invention.
Figure 4:
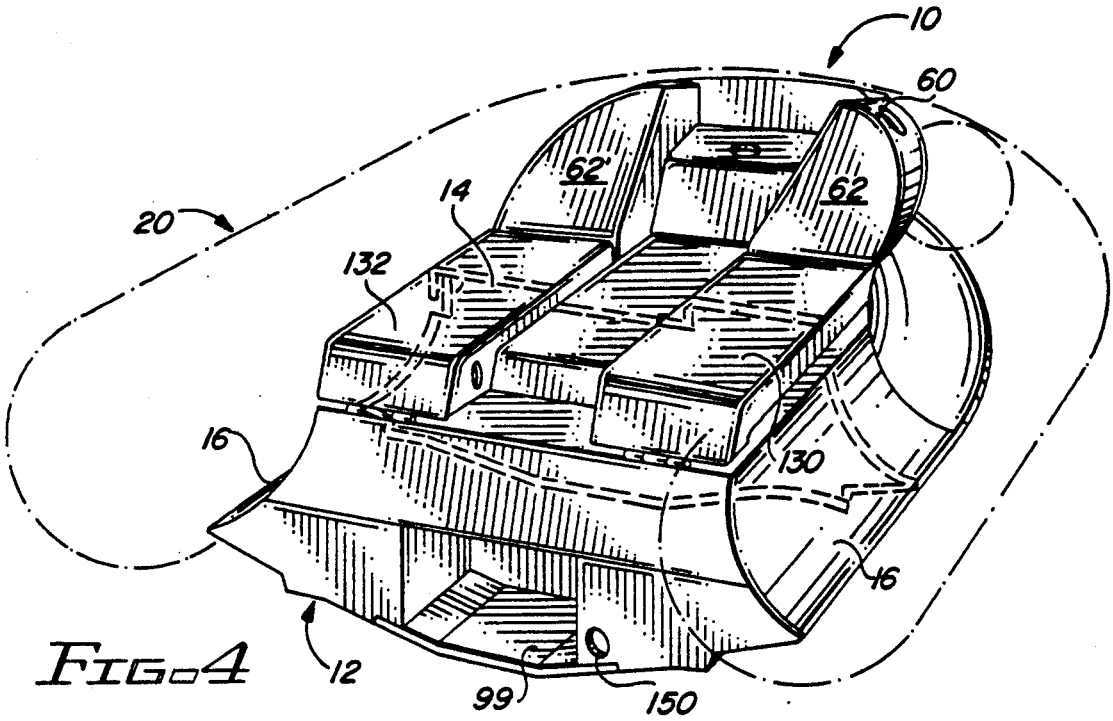
FIG. 4 is a rear perspective view of a rigid hull portion of the present invention, with buoyancy chambers thereof indicated by phantom lines.
Figure 7:
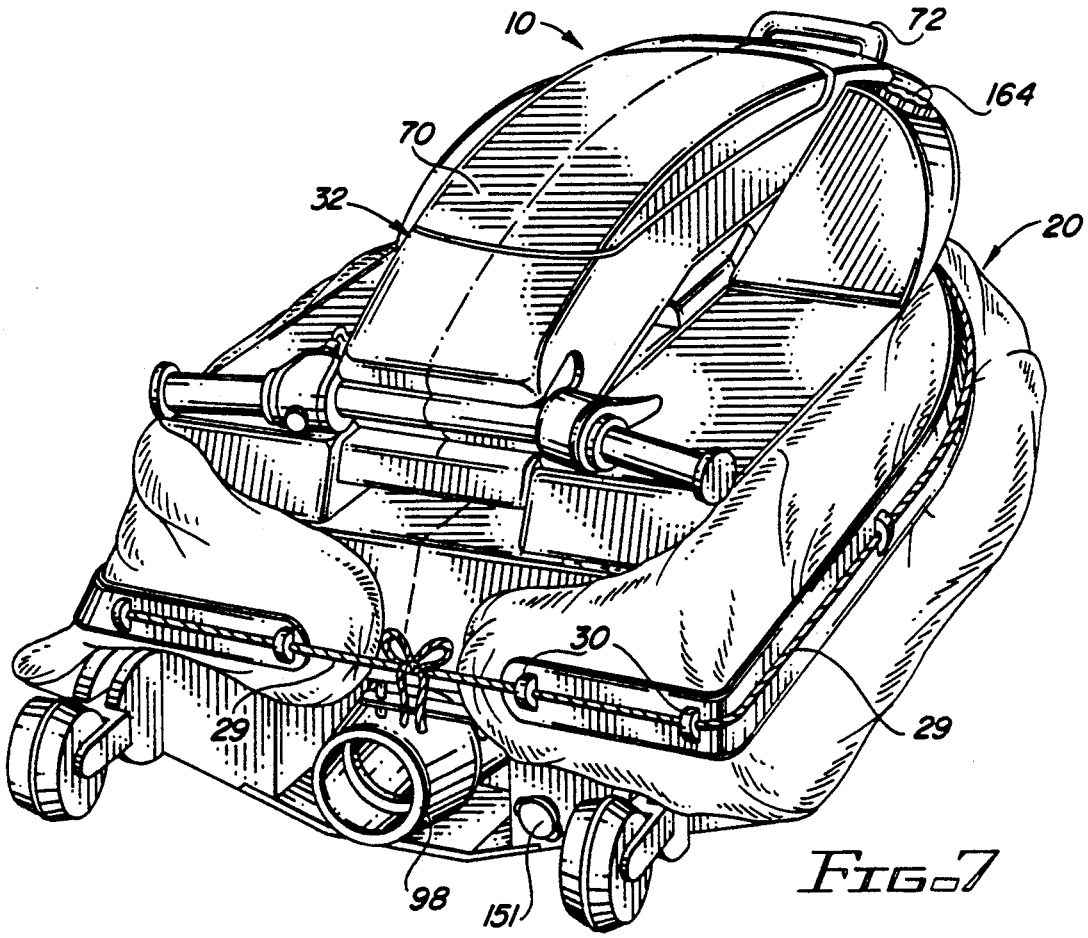
FIG. 7 is a rear perspective of the personal marine transport shown in a fully collapsed mode for stowage.

With reference to FIG. 1, the present invention is directed to a personal marine transport generally indicated as 10 including a rigid hull 12 having an upper exposed deck 14 structured to facilitate standing thereon during use. An air filled buoyancy membrane 20 is attached to and extend partially around the rigid hull 12. The air filled buoyancy membrane includes independent inflatable air chambers, including side buoyancy chambers 22, 24 and a forward buoyancy chamber 26 extending around the bow of the rigid hull 12. The sides and bow of the hull include a concave channel 16 specifically sized and configured to receive the buoyancy membrane in attached, congruent engagement therewith, as best shown in FIG. 4. The inflated buoyancy chambers 22, 24 and 26 provide increased stability to the personal marine transport 10 as well as providing a protective bumper around the rigid hull 12. Preferably, the buoyancy chambers 22, 24 and 26 are integrally formed and fixedly attached to the rigid hull with a suitable water resistant adhesive such as an epoxy that is adapted to withstand prolonged exposed to either fresh or salt water. The side buoyancy chambers 22, 24 are provided with flexible grab handles 28, 28' to facilitate climbing aboard the personal marine craft from within the water. A life line 29 is fitted about the outer perimeter of the buoyancy chambers 22, 24 and 26, being held thereto by line holders 30 disposed at spaced intervals about the outer perimeter of the buoyancy chambers.

A steering assembly 32 includes steering handle support post 34 hingedly attached to the rigid hull 12 at the bow. The steering handle support post 34 is preferably formed of the same rigid material as the hull 12, such as fiberglass, and is shaped and configured to conform with the overall contour and configuration of the hull 12. A steering bar 36 is movably attached to an upper free end of the steering handle support post 34 and is preferably pivotally movable about a pivotal connection 37. The steering handle 36 includes left and right handle grip portions 38, 39 on opposite ends thereof. Various control members such as a spring loaded throttle 40 and start and stop ignition switch assembly 42 are provided on the steering handle 36. A floatable wrist lanyard 44 attaches to a kill switch 45 on the ignition switch assembly 42. Removal of the wrist lanyard from the kill switch 45 serves to cut off the engine to stop the movement of the personal marine transport 10 in the event that the operator is thrown off.

The personal marine transport is designed to be driven in either a standing or seated position. If it is desired to ride in a seated position, a collapsible seat 50 raises from the deck 14 to an upright position, as shown in FIGS. 1 and 3. In the collapsed position, shown in FIGS. 2 and 5, the seat assembly forms a central portion of the deck 14 which is flush with a remainder of the surrounding deck surface. The seat assembly 50 includes a vertical extension portion 52 and a seat 54 hingedly attached to free distal end of the vertical extension 52. In the upright position, the seat 54 folds down in a generally horizontal position to allow sitting thereon.

The foredeck 60 of the rigid hull 12 rises substantially above a remainder of the deck 14 and includes sloped portions 62, 62' to allow placement of the operator's feet thereon while in the seated position. The steering handle support post 32 is hingedly attached to the raised foredeck 60 between the sloped foot rests 62, 62' and includes a spring assisted hinge assembly 66 enabling the steering bar support post to be easily moved between a raised, operable position and a collapsed, stowed position. The spring assisted hinge is specifically structured to lock the steering bar support post in the fully raised, upright position for operation by including a relief or any suitable conventionally known catch structure. When in the raised position, the steering handle 36, and handle grip portions 38, 39 are positioned at a preferred height to enable steering in either the seated position or the standing position.

Figure 2:
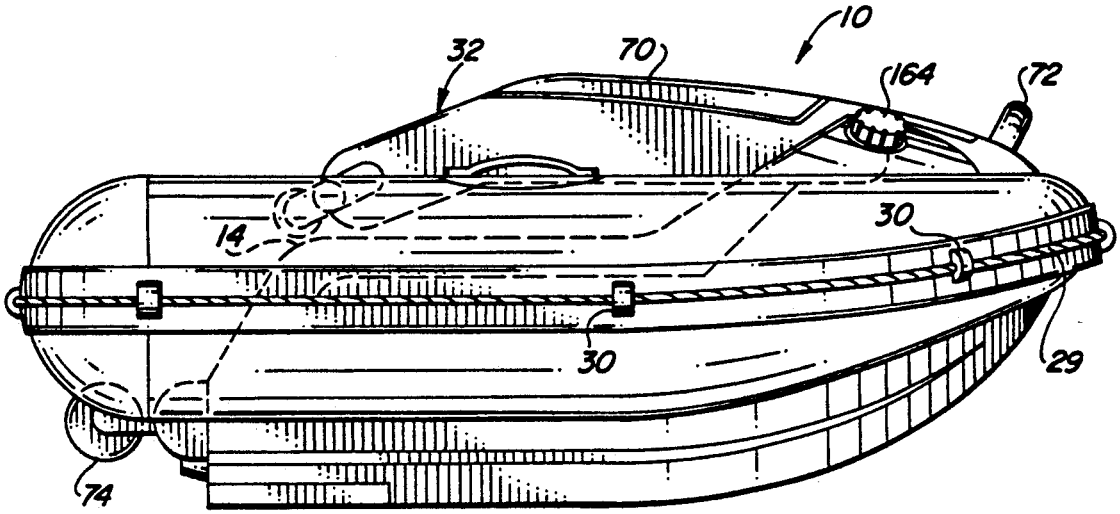
FIG. 2 is a side elevation of the personal marine transport shown in a collapsed mode for stowage.
Figure 3:
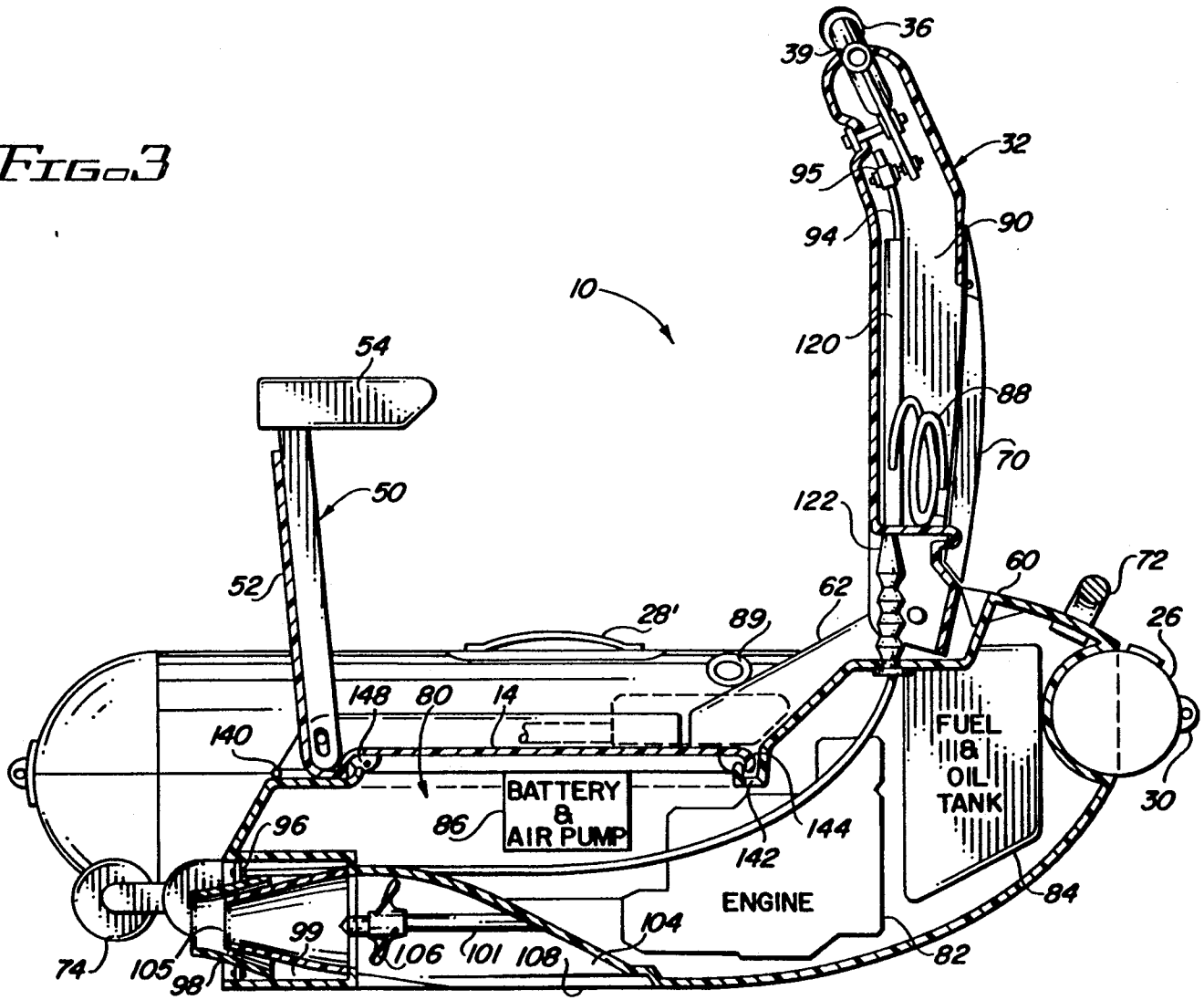
FIG. 3 is a side elevation of the personal marine transport shown in partial section, illustrating the structure of the interior engine compartment and steering posts thereof.

With reference to FIG. 2, the steering bar support post 32 is shown in a collapsed position extending substantially along the length of the rigid hull 12 in generally parallel relation to the deck 14. As shown in FIGS. 2 and 3, the steering bar support post 32 is provided with an upholstered storage cover 70 which is removable to provide access to an interior storage compartment 90 within the steering bar support post 32. The upholstered storage cover 70 includes a padded interior core so as to provide a comfortable seat cushion. In this manner, the steering bar support post 32 may be collapsed by the user while adrift on the water surface in order fish, sunbathe, or relax, with the storage cover 70 providing a comfortable seating area. A lifting handle 72 is fixedly mounted to the bow of the rigid hull 12. The lifting handle 72 provides a convenient means for mooring or towing the personal marine transport as well as a means for lifting the craft for transport to and from the water launching site. To further facilitate transport on land, the personal marine transport is provided with retractable wheels 74, 74' which are extendable, as seen in the figures, to allow the user to grasp handle 72 as the wheels 74, 74' roll across the land surface. The retractable wheels 74, 74' are preferably structured to lock in either the retracted position or a raised position once the personal marine transport is launched in the water.

The rigid hull 12 includes an engine compartment 80 below the deck 14 and foredeck portion 60. A 5–7 horsepower engine 82 having a displacement of approximately 100 cc's, is fitted within the engine compartment 80 along with a fuel and oil tank 84. The engine 82 is specifically sized to fit within the confined space of the compartment 80 applying enough power to propel the marine craft up to a maximum speed of approximately 9 knots. A battery and air pump, schematically shown as 86, are further provided within the engine compartment 80. An air hose 88 is connected to the air pump 86 and is preferably stored within a storage compartment 90 within the steering bar support post 32. The air hose 88 is of a length sufficient to reach various air fill valves, such as 89 on the air chambers 22, 24, 26 to facilitate inflation thereof. The engine supplies the power necessary to operate the air pump 86, thereby eliminating the need for an external power or manually operated pressurized air supply source in order to inflate the buoyancy chambers for use. In this manner, the air chambers can be easily inflated and deflated, increasing the degree of mobility and stowing capability.

As best illustrated in FIG. 3, the steering bar 36 is interconnected with a steering cable 94 in such a manner so as to cause the steering cable 94 to be pulled upwardly or pushed downwardly upon pivotal movement of the left and right handle grip portions 38, 39. The steering cable 94 connects at one end to a connection point 95 with the steering bar 36 and at an opposite end to a connection point 96 linked to a directional jet nozzle 98 pivotally mounted within a port 99 in the transom of the rigid hull 12. Movement of the handle grip portions 38, 39 on the steering bar 36 and, accordingly, movement of the steering cable 94 serves to move the directional jet nozzle 98 in a manner so as to direct thrust outwardly therefrom at controlled angles relative to the hull 12.

A drive shaft 101 extends from the engine 8 and terminates within a thrust channel 104 extending from a bottom of the rigid hull 12 to a discharge 105 adjacent the directional jet nozzle 98. A propeller 106 is fitted to a distal end of the drive 101 and is disposed within the thrust channel 104 so as to be rotatable therein. Upon driven rotation of the drive shaft 101 and attached propeller by the engine 82, water is drawn up through a water intake 108 on the bottom of the hull 12 at one end of the thrust channel 104. The water intake is preferably fitted with a grating 109 to prevent large objects such as rocks and driftwood from being sucked up through the thrust tunnel 104, which could possibly damage the propeller 106. The water is then subsequently forced out through the discharge end 105 and through directional jet nozzle to create a propulsive thrust forcing the personal marine transport 10 in a generally forward direction. A plate 110, including the grating 109, is fitted to the bottom of the hull 12 so as to protectively shield the propeller 106 from direct contact.

The steering cable 94 is contained within a protective casing 120 to guard against corrosion from exposure to water. The hinged connection 66 between the steering handle support post and raised portion 60 of the deck 14 includes a protective, flexible water-tight boot 122 extending from the storage compartment 90 in the steering handle support post 94 and the deck 14 of the rigid hull 12. The steering cable 94 and air hose 88 are fitted through the flexible boot 122 which is specifically structured to allow the steering handle support post 34 to be moved between the raised, operable position and the lowered position.

The deck 14 includes opposite side portions 130, 132. As best illustrated in FIGS. 1 and 3, the side deck portions 130, 132 are hingedly attached along a rear edge to the rigid hull 12 with hinges 140 so as to allow the deck portions 130, 132 to be opened, thereby facilitating access to the engine compartment 80. A gutter 142 extends about the periphery of the engine compartment opening and is specifically designed to catch water therein for draining off the transom as the marine transport 10 moves forward. The side deck portions 130 and 132 include a flanged lip 144 which fits down into the gutter 142. A gasket 148 extends about the gutter 142 and is structured and disposed to engage an undersurface of the side deck portions 130, 132 adjacent the flanged lip 144, thereby preventing water from entering the engine compartment from within the gutters 142. Any water which inadvertently enters the engine compartment can be later drained through a drain hole 150 in the transom of the hull 12. The drain hole is normally closed off with a plug 151 when the water craft 10 is in the water.

Figure 5:
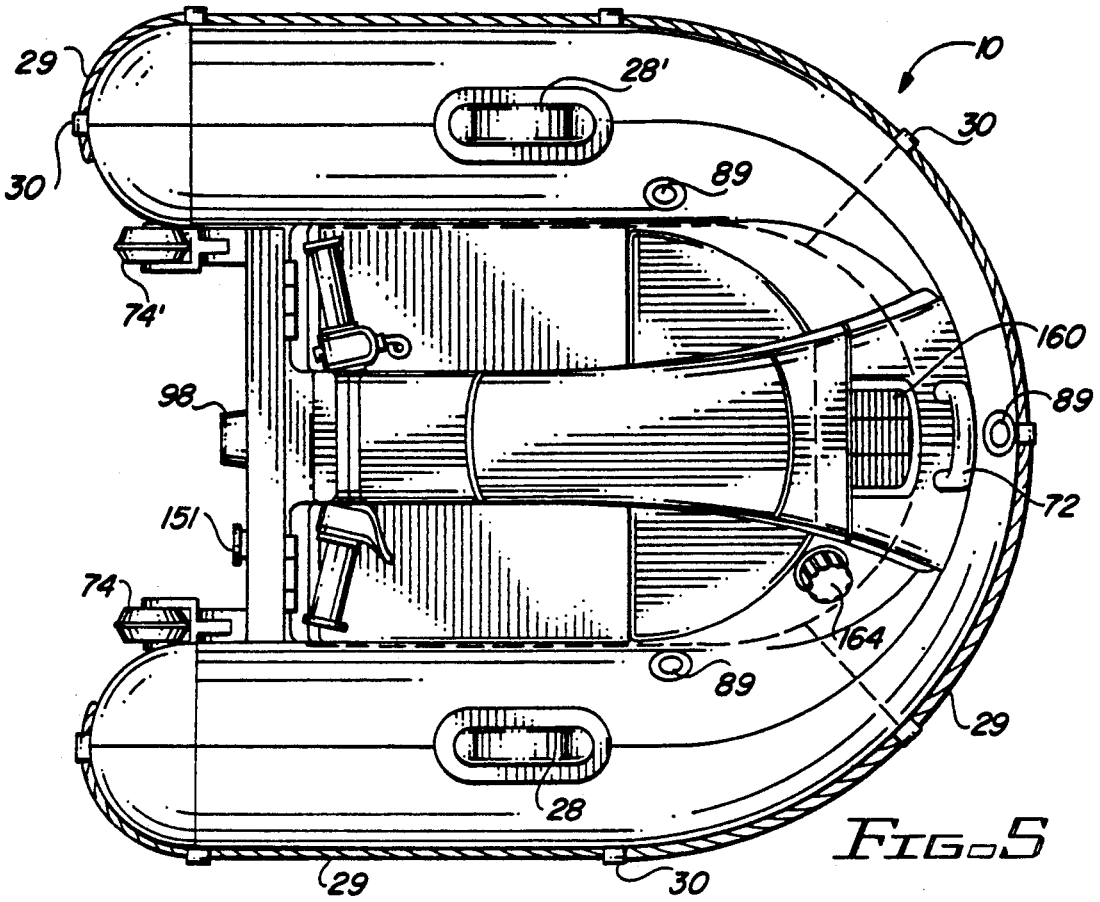
FIG. 5 is a top plan view of the personal marine transport.
Figure 6:
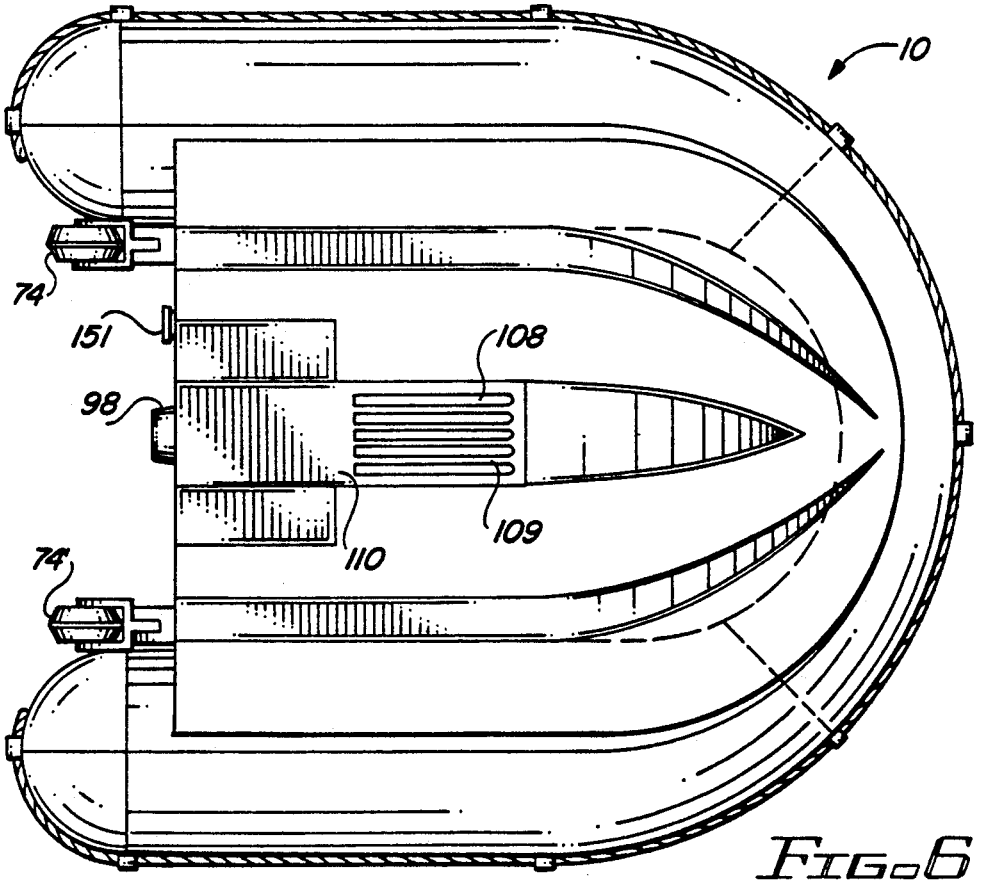
FIG. 6 is a bottom plan view of the personal marine transport.

With specific reference to FIG. 5, the bow of the rigid hull 12 is provided with an air intake 160 to provide ventilation to the engine compartment 80. Also located on the bow portion of the rigid hull 12 is a fuel filler cap 164 which is removable to facilitate filling of fuel and oil into the fuel tank 84.

After use, the personal marine transport 10 can be fully collapsed to facilitate transport and storage within a minimal amount of space. With the buoyancy chambers 22, 24, 26 deflated, the distal ends of the life line 29 can be drawn together at the stern and tied off so as to maintain the buoyancy membrane 20 close against the rigid hull 12.

What is claimed is:

1. A personal water craft for transporting a user across the surface of a body of water comprising:

a rigid hull including a top portion, an underside portion, a rear transom, and a side wall structure extending from opposite ends of said transom about a bow and opposite sides of said hull in surrounding relation to a water-tight internal engine compartment within said hull, inflatable buoyancy means attached to said side wall structure for providing increased stability and protection from impact to said hull, said buoyancy means including a tubular shaped, collapsible membrane having at least one air-tight internal buoyancy chamber therein structured to be inflated with air to a predetermined pressure, propulsion means for moving the craft along the water surface and being structured and disposed to generate a propulsive thrust, drive means within said engine compartment drivingly interconnected with said propulsion means for driven operation thereof, inflation means for inflating said buoyancy means and including an air pump powered by said drive means and structured to provide pressurized air flow to said air chamber, power means for supplying power to said drive means for operation thereof, and a steering assembly attached to said hull and structured and disposed to selectively direct the propulsive thrust at a plurality of controlled, angular directions relative to the hull so as to effectively control direction of movement of the craft along the water surface.

2. A water craft as set forth in claim 1 wherein said top portion includes a substantially flat exposed deck sized and configured to allow the user to stand thereon.

3. A water craft as set forth in claim 2 wherein said deck is hingedly attached to a remainder of said hull and is movable between a raised position and a lower position to facilitate access to said engine compartment.

4. A water craft as set forth in claim 3 wherein said side wall structure is structured and configured for mating engagement and attachment with a congruently configured mating portion of an external surface of said collapsible membrane.

5. A water craft as set forth in claim 4 wherein said collapsible membrane includes three independent, air-tight buoyancy chambers including opposite side buoyancy chambers extending substantially along corresponding opposite sides of the water craft and a bow buoyancy chamber extending about the bow of the water craft and defining a forward bumper.

6. A water craft as set forth in claim 5 wherein said steering assembly includes a steering bar including left and right handle grip portions.

7. A water craft as set forth in claim 6 wherein said steering assembly further includes a steering handle support post structured and disposed for attachment of said steering bar thereto.

8. A water craft as set forth in claim 7 wherein said steering bar is movably attached to said steering handle support post such that movement of said left and right handle grip portions facilitate controlled direction of the propulsive thrust so as to effectively control direction of movement of the water craft.

9. A water craft as set forth in claim 8 wherein said steering handle support post is hingedly attached to said top portion of said hull near the bow so as to be movable between a raised, operable position and a lowered, stowed position extending substantially along the length of said deck in substantially parallel relation thereto.

10. A water craft as set forth in claim 9 wherein said steering handle support post includes locking means for locking said steering handle support post in said raised, operable position.

11. A water craft as set forth in claim 10 further including a collapsible seat hingedly attached to said deck and movable between a raised, sitting position and a collapsed, stored position.

12. A water craft as set forth in claim 11 wherein said collapsible seat is structured and disposed such that an upper surface of said seat is flush with a surface of said exposed deck when in said collapsed, stored position.

13. A water craft as set forth in claim 12 wherein said under side portion of said hull includes a water intake structured and disposed to direct water from the water surface through said propulsion means.

14. A water craft as set forth in claim 13 wherein said propulsion means includes a thrust tunnel extending from said water intake to a discharge port in said transom for directing the water therethrough to generate the propulsive thrust.

15. A water craft as set forth in claim 14 wherein said propulsion means further comprises a drive shaft drivingly interconnected and extending from said drive means and into said thrust tunnel and including a propeller attached to a distal end thereof within said thrust tunnel, wherein driven rotation of said drive shaft and propeller and causes the water to be drawn through said water intake.

16. A water craft as set forth in claim 15 wherein said steering assembly further includes a directional jet nozzle movably mounted within said discharge port and structured and disposed to direct the water being forcibly discharged so as to control the direction of the propulsive thrust.

* * * * *